US009960516B2

(12) United States Patent
Onuma

(10) Patent No.: US 9,960,516 B2
(45) Date of Patent: May 1, 2018

(54) CONNECTION TERMINAL

(71) Applicant: YAZAKI CORPORATION, Tokyo (JP)

(72) Inventor: Masanori Onuma, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days. days.

(21) Appl. No.: 15/210,066

(22) Filed: Jul. 14, 2016

(65) Prior Publication Data

US 2016/0322729 A1 Nov. 3, 2016

Related U.S. Application Data

(63) Continuation of application No. PCT/JP2015/053766, filed on Feb. 12, 2015.

(30) Foreign Application Priority Data

Feb. 18, 2014 (JP) ..... 2014-028469
Feb. 18, 2014 (JP) ..... 2014-028472

(51) Int. Cl.
*H01R 13/11* (2006.01)
*H01R 13/115* (2006.01)

(52) U.S. Cl.
CPC ..... *H01R 13/113* (2013.01); *H01R 13/115* (2013.01)

(58) Field of Classification Search
CPC .... H01R 13/113; H01R 13/11; H01R 13/187; H01R 43/16; H01R 4/185
USPC ..... 439/852, 842
See application file for complete search history.

(56) References Cited

U.S. PATENT DOCUMENTS 6,290,553 B1 * 9/2001 Sato ..... H01R 13/187 439/843
6,547,608 B2 4/2003 Sato et al.
7,985,106 B2 * 7/2011 Sugiyama ..... H01R 13/113 439/852

(Continued)

FOREIGN PATENT DOCUMENTS

JP H11-144789 A 5/1999
JP 2002-063961 A 2/2002

(Continued)

OTHER PUBLICATIONS

Office action dated Oct. 31, 2017 in a counterpart Japanese patent application.

*Primary Examiner* — Hien Vu
(74) *Attorney, Agent, or Firm* — Metrolexis Law Group, PLLC

(57) ABSTRACT

A contacting section protrudes from the elastic piece, has a hemispherical shape, and includes a hollow portion and a contact portion. The hollow portion is located at a center of the contacting section, has a recess in a direction away from a connecting part of a counterpart terminal, and has no contact with a surface of the connecting part. The contact portion is located to sandwich the hollow portion in a plan view of the elastic piece and comes in contact with the surface of the connecting part. The hollow portion has a circular shape in the plan view of the elastic piece. The contact portion has an annular shape located on an outer periphery of the hollow portion in the plan view of the elastic piece.

7 Claims, 11 Drawing Sheets

(56) References Cited

U.S. PATENT DOCUMENTS

| | | | | |
|---|---|---|---|---|
| 7,988,505 | B2 * | 8/2011 | Hotea | H01R 13/187<br>439/852 |
| 8,152,576 | B2 * | 4/2012 | Nakamura | H01R 13/055<br>439/852 |
| 2001/0051472 | A1 * | 12/2001 | Sato | H01R 13/11<br>439/852 |
| 2012/0156947 | A1 * | 6/2012 | Tyler | H01R 13/113<br>439/842 |

FOREIGN PATENT DOCUMENTS

| | | | |
|---|---|---|---|
| JP | 2004-139826 | A | 5/2004 |
| JP | 2008-210755 | A | 9/2008 |
| JP | 2011-108595 | A | 6/2011 |
| JP | 2011-119100 | A | 6/2011 |

* cited by examiner

CONNECTION TERMINAL

CROSS REFERENCE TO RELATED APPLICATION

This application is a Continuation of PCT Application No. PCT/JP2015/053766, filed on Feb. 12, 2015, and claims the priority of Japanese Patent Application No. 2014-028469, filed on Feb. 18, 2014, and Japanese Patent Application No. 2014-028472, filed on Feb. 18, 2014, the content of which is incorporated herein by reference.

BACKGROUND

Technical Field

The disclosure relates to a connection terminal, and more particularly to a female connection terminal having a contacting section provided on a resiliently deformable elastic piece to be connected to a tab-shaped connecting part of a male terminal.

Related Art

Japanese Unexamined Patent Application Publication No. 2008-210755 proposes a connection terminal provided with an elastic piece which provides urging force toward a connecting part of a counterpart terminal and a contacting section which protrudes from the elastic piece toward the connecting part of the counterpart terminal and which is in contact with a surface of the connecting part of the counterpart terminal due to the urging force of the elastic piece.

In this connection terminal, the connecting part of the counterpart terminal is formed in a tab shape, and the elastic piece is provided in a box-shaped main body. By inserting the connecting part of the counterpart terminal into the main body, the contacting section comes in contact with the connecting part of the counterpart terminal due to the urging force of the elastic piece, and the counterpart terminal and the connection terminal are electrically connected.

SUMMARY

Incidentally, regarding the connection terminal in Japanese Unexamined Patent Application Publication No. 2008-210755, it is mentioned that increasing the contact area of the contacting section to the connecting part of the counterpart terminal is effective in order to reduce the contact resistance between the contacting section and the connecting part of the counterpart terminal.

In order to increase the contact area of the contacting section, it is conceivable to improve the contact load of the contacting section applied to the connecting part of the counterpart terminal, or to enlarge the contacting section. However, for this purpose, it is necessary to complicate the spring structure for applying urging force to the elastic piece or to make the connection terminal larger.

An object of the disclosure is to provide a connection terminal capable of reducing the contact resistance with a simple structure while suppressing increase in size.

Here, the present inventor has found that the current that flows through the contacting section does not flow evenly with respect to the contact area and there are places where the current easily flows and less easily flows. In particular, it has been found that the current that flows through the contacting section concentrates in the outer peripheral portion when contact is made with the contacting section in a single circular shape.

A connection terminal in accordance with some embodiments includes: an elastic piece configured to provide urging force toward a connecting part of a counterpart terminal; and a contacting section protruding from the elastic piece toward the connecting part of the counterpart terminal and configured to come in contact with a surface of the connecting part of the counterpart terminal by the urging force of the elastic piece. The contacting section includes a hollow portion located at a center of the contacting section, having a recess in a direction away from the connecting part of the counterpart terminal, and having no contact with the surface of the connecting part of the counterpart terminal, and a contact portion located to sandwich the hollow portion in a plan view of the elastic piece and configured to come in contact with the surface of the connecting part of the counterpart terminal.

According to the above configuration, it is possible to provide a connection terminal capable of suppressing increase in its size and reducing the contact resistance with a simple structure.

The contacting section may have a hemispherical shape, the hollow portion may have a circular shape in the plan view of the elastic piece, and the contact portion may have an annular shape located on an outer periphery of the hollow portion in the plan view of the elastic piece.

According to the above configuration, the contacting section is formed in a hemispherical shape and has a circular hollow portion which is formed by recessing the central portion of the contacting section in a direction away from the connecting part of the counterpart terminal and an annular contact portion formed on the outer periphery of the hollow portion. Thus, it is possible to suppress increase in the size of the contacting section and allows a current to flow easily to the annular contact portion positioned on the outer periphery of the hollow portion.

Therefore, it is possible to reduce the contact resistance between the contacting section and the connecting part of the counterpart terminal without complicating the spring structure for applying urging force to the elastic piece or increasing the size of the connection terminal.

Therefore, in the above-mentioned connection terminal, by having a hollow portion and an annular contact portion of simple structures, the contacting section can suppress increase in size and reduce the contact resistance with simple structures.

The contacting section may have a semi-cylindrical shape extending in a width direction of the elastic piece, the hollow portion may have a groove shape located in the center of the contacting section in a length direction of the elastic piece, and the contact portion may have a belt shape located on each side of the hollow portion in the length direction of the elastic piece.

According to the above configuration, the contacting section is formed in a semi-cylindrical shape extending in the width direction of the elastic piece, and has a groove-shaped hollow portion formed by recessing the central portion of the contacting section in the length direction of the elastic piece in a direction away from the connecting part of the counterpart terminal, and a contact portion in a belt shape, which is formed on each side of the hollow portion in the length direction of the elastic piece. Thus, a current can be allowed to flow easily to the contact portions which are spaced so as to sandwich the hollow portion while suppressing the enlargement of the contacting section.

Therefore, the contact resistance between the contacting section and the connecting part of the counterpart terminal can be reduced without complicating the spring structure for applying urging force to the elastic piece or increasing in the size of the connection terminal.

Therefore, since the contacting section has the hollow portion and the contact portion of simple structures, such a connection terminal can suppress increase in its size and reduce the contact resistance with simple structures

DETAILED DESCRIPTION

Figure 1:
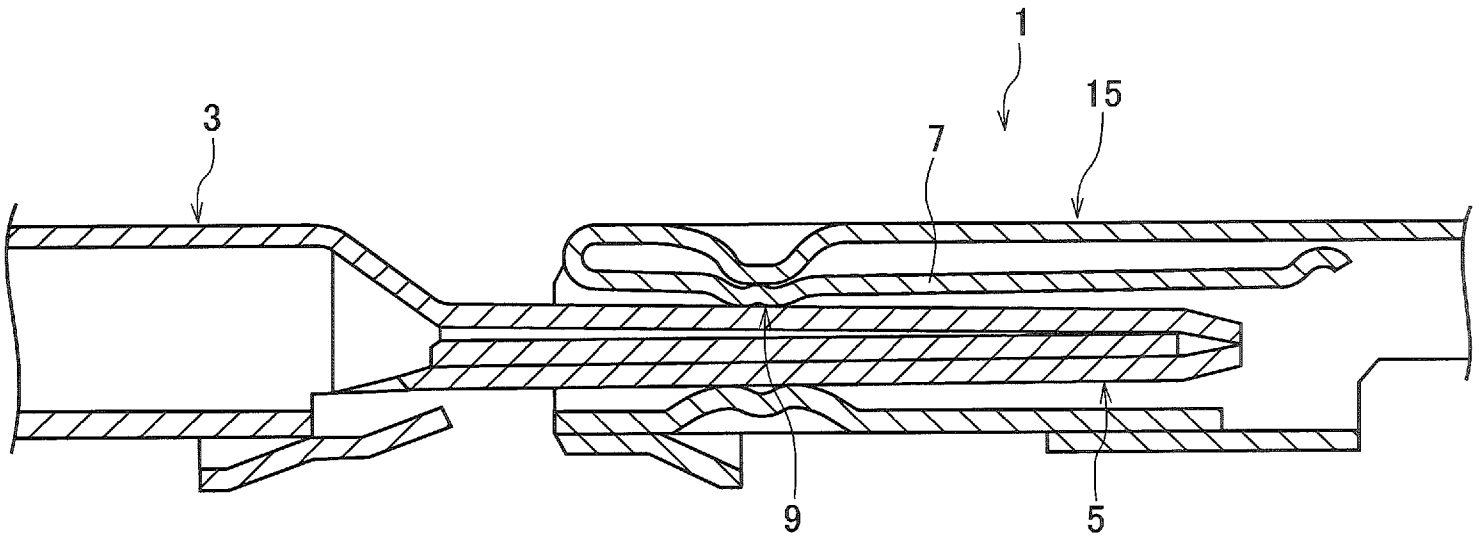
FIG. 1 is a cross-sectional view of a connection terminal according to a first embodiment of the present invention.
Figure 2A:
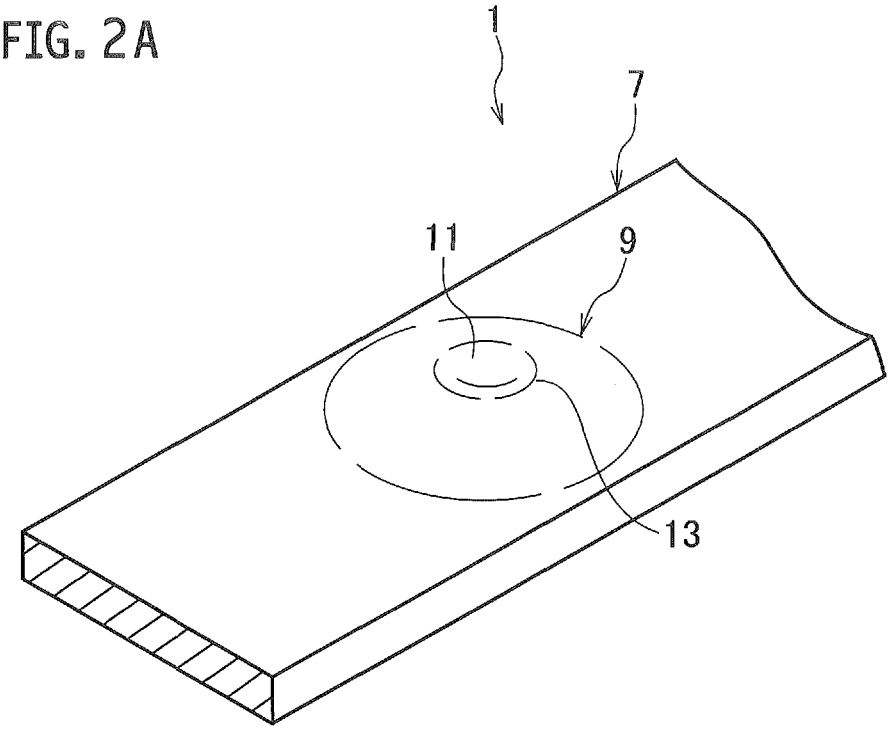
FIG. 2A is a perspective view of an elastic piece of the connection terminal according to the first embodiment of the present invention.
Figure 2B:
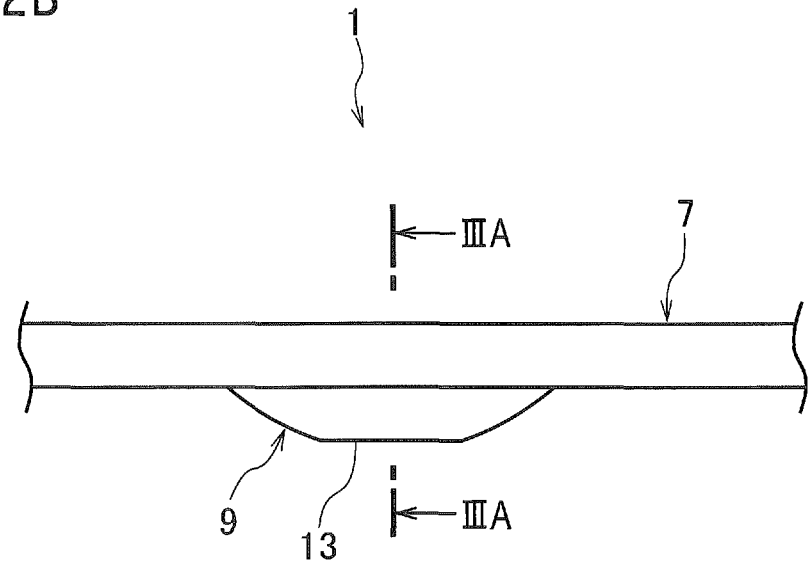
FIG. 2B is a side view of the elastic piece in FIG. 2A.

A connection terminal 1 according to a first embodiment of the present invention will be described with reference to FIGS. 1 to 7.

The connection terminal 1 includes an elastic piece 7 which provides (has) urging force toward a connecting part 5 of a counterpart terminal 3 and a contacting section 9 which protrudes from the elastic piece 7 toward the connecting part 5 of the counterpart terminal 3 and which comes in contact with a surface of the connecting part 5 of the counterpart terminal 3 by the urging force of the elastic piece 7.

The contacting section 9 is formed in a hemispherical shape, and has a hollow portion 11 which is formed by recessing the central portion of the contacting section 9 in a direction away from the connecting part 5 of the counterpart terminal 3 and which is circular in a plan view of the elastic piece 7, and an annular contact portion 13 formed on the outer periphery of the hollow portion 11.

As shown in FIGS. 1 to 3B, the connection terminal 1 is composed of a female terminal having a box-shaped electrical connector 15. The connection terminal 1 is electrically connected to a terminal portion of a wire (not shown) connected to a power source or an apparatus, or to a circuit board (not shown) arranged on a power source or an apparatus, or the like.

The connecting part 5 of the counterpart terminal 3 composed of a male terminal having a tab-shaped connecting part 5 connected to a power source, an apparatus or the like similarly to the connection terminal 1 is inserted into the electrical connector 15 of the connection terminal 1, and the connection terminal 1 and the counterpart terminal 3 are electrically connected. The elastic piece 7 is provided in the electrical connector 15 of the connection terminal 1.

The elastic piece 7 is provided by bending the upper wall of the electrical connector 15 toward the inside. With respect to the connecting part 5 of the counterpart terminal 3 inserted into the electrical connector 15, the elastic piece 7 provides predetermined urging force toward the connecting part 5 of the counterpart terminal 3.

The elastic piece 7 is provided with the contacting section 9, and by inserting the connecting part 5 of the counterpart terminal 3 into the electrical connector 15, the elastic piece 7 urges the contacting section 9 toward the connecting part 5 of the counterpart terminal 3 so as to produce a predetermined contact load and brings the contacting section 9 into contact with the connecting part 5 of the counterpart terminal 3.

The contacting section 9 is formed in a hemispherical shape by protruding the central portion in the width direction of the elastic piece 7 toward the connecting part 5 of the counterpart terminal 3 inserted into the electrical connector 15 (toward the lower wall of the electrical connector 15), and has a circular hollow portion 11 and an annular contact portion 13.

The hollow portion 11 is formed by recessing the central portion of the hemispherical contacting section 9 in the direction away from the connecting part 5 of the counterpart terminal 3 (toward the upper wall of the electrical connector 15) in a circular shape, such that a surface thereof facing the connecting part 5 of the counterpart terminal 3 has a hollow. The annular contact portion 13 is formed in the outer peripheral portion of the hollow portion 11. The hollow part of the hollow portion 11 does not come in contact with the surface of the connecting part 5 of the counterpart terminal 3 inserted into the electrical connector 15, that is, having no contact therewith.

The contact portion 13 is formed on a surface facing the connecting part 5 of the counterpart terminal 3, as a peripheral portion of the circular hollow portion 11 in a plan view of the elastic piece 7, and is formed annularly. The contact portion 13 comes in contact with a surface of the connecting part 5 of the counterpart terminal 3 inserted into the electrical connector 15 by urging force of the elastic piece 7 and electrically connects the connection terminal 1 and the counterpart terminal 3.

Here, the contact resistance can be obtained by the following theoretical formula (Formula 1).

$$Rc=(\rho/D)+(\rho/2na)$$

Figure 5:
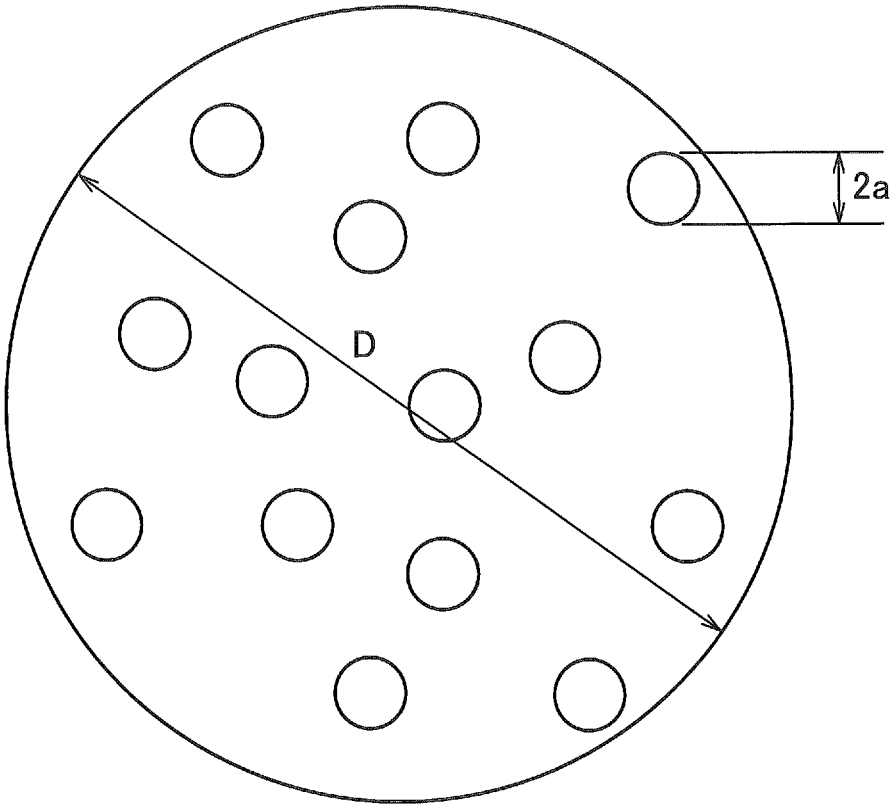
FIG. 5 is a schematic diagram showing numerical values of Formula 1.

Here, the symbol Rc represents the contact resistance, and ρ represents the volume resistivity of the metal. As shown in FIG. 5, the symbol D represents the apparent contact surface diameter, 2a represents the actual contact surface diameter, and n represents the number of actual contact surfaces.

As is apparent from the theoretical formula, in order to reduce the contact resistance (Rc), at least any one of the apparent contact surface diameter (D), the actual contact surface diameter (2a), the number of actual contact surfaces (n) needs to be increased.

From this fact, since it is very difficult to appropriately design to increase the actual contact surface diameter (2a) or the number of actual contact surfaces (n), designing to increase the apparent contact surface diameter (D) is effective.

Figure 3A:
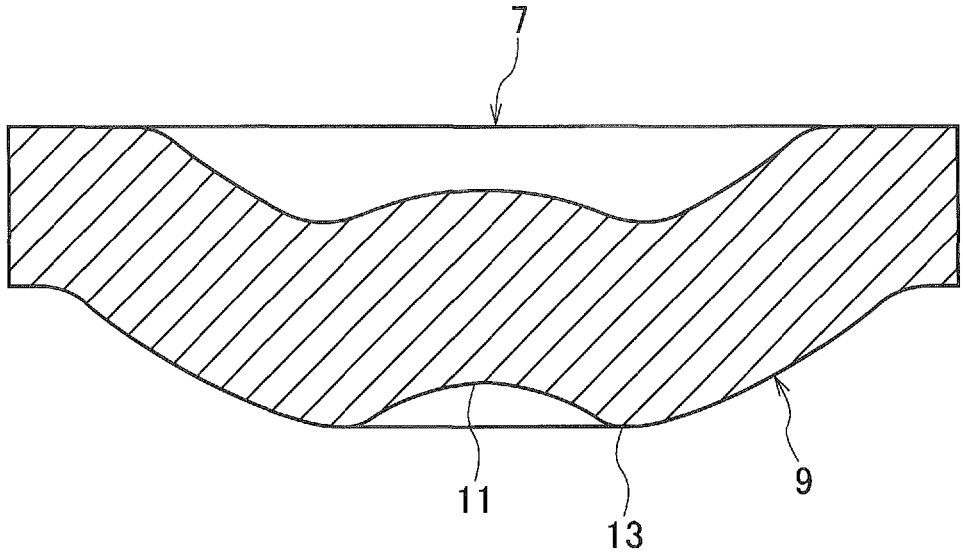
FIG. 3A is a cross-sectional view taken along IIIA-IIIA in FIG. 2B.
Figure 3B:
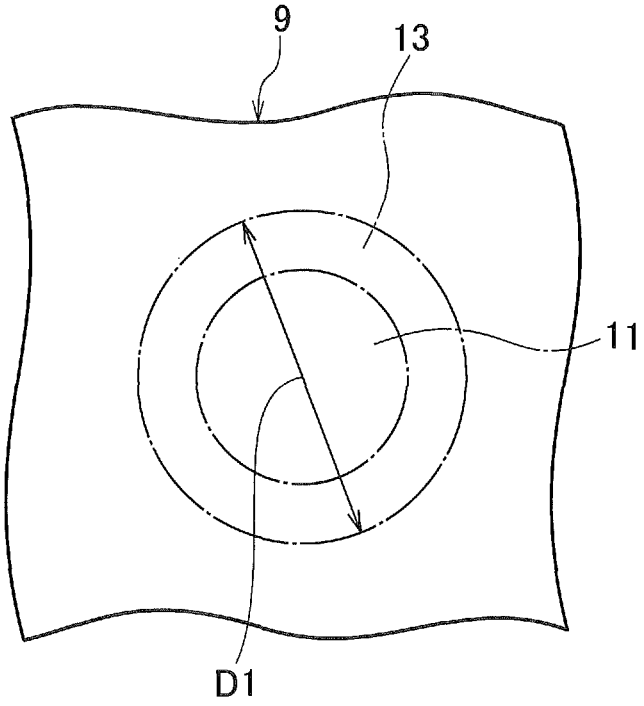
FIG. 3B is a front view of the elastic piece in FIG. 3A.
Figure 4A:
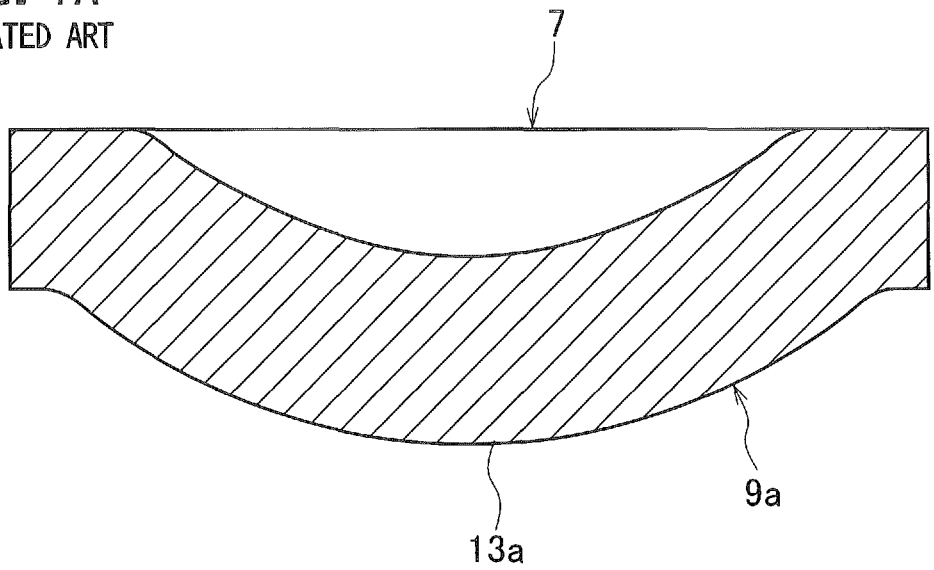
FIG. 4A RELATED ART
FIG. 4A is a cross-sectional view of a contacting section of a related example.
Figure 4B:
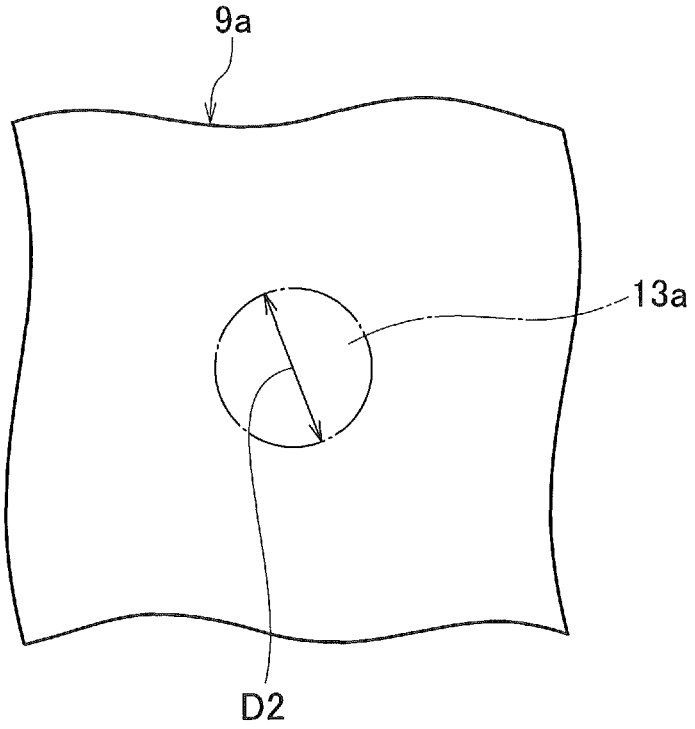
FIG. 4B RELATED ART
FIG. 4B is a front view of the contacting section in FIG. 4A.

Therefore, as shown in FIGS. 3A and 3B, the outer diameter of the contact portion 13 in the contacting section 9, that is the apparent contact surface diameter D1 is set to be larger than the apparent contact surface diameter D2, which is the outer diameter of the circular contact portion 13*a* in a hemispherical contacting section 9*a*, which does not have the related hollow portion 11 or the contact portion 13, shown in FIGS. 4A and 4B.

Figure 6:
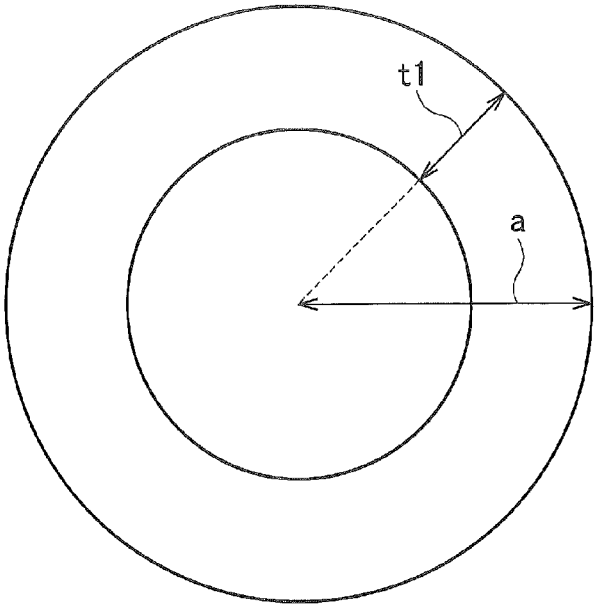
FIG. 6 is a schematic view when the contacting section is formed in a single circular shape.

On the other hand, in order to verify the flow of current in the contacting section 9, the behavior of the constriction resistance (conductivity ratio) with respect to the apparent contact area is verified in a model shown in FIG. 6.

Figure 7:
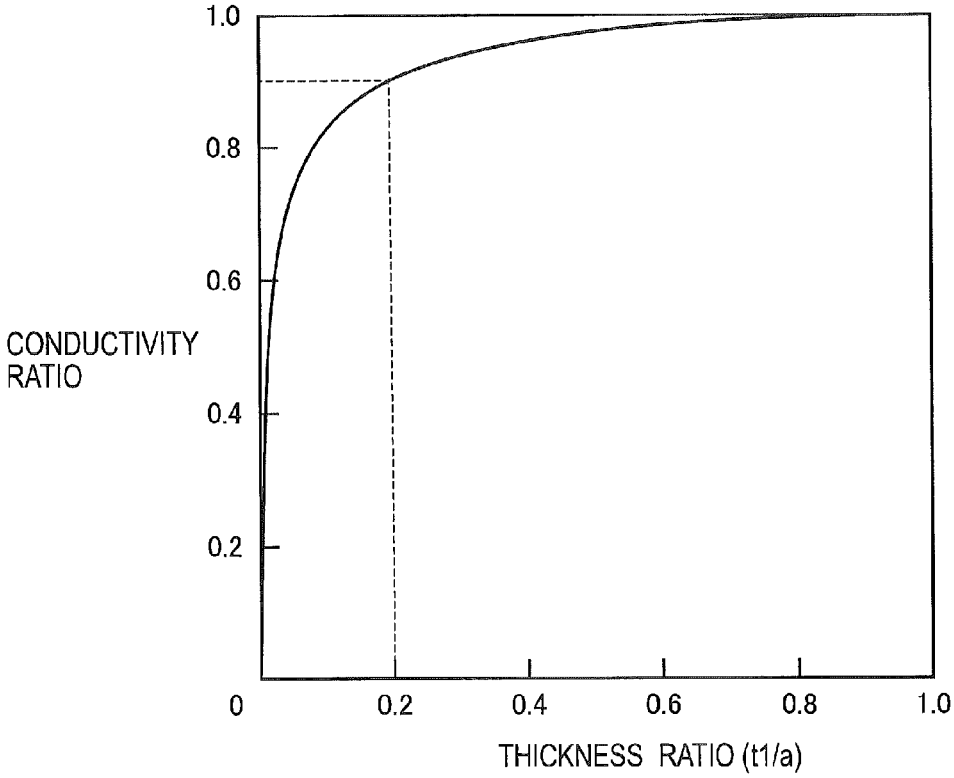
FIG. 7 is a diagram showing variation in a conductivity ratio with respect to a thickness ratio of the contacting section.
Figure 8:
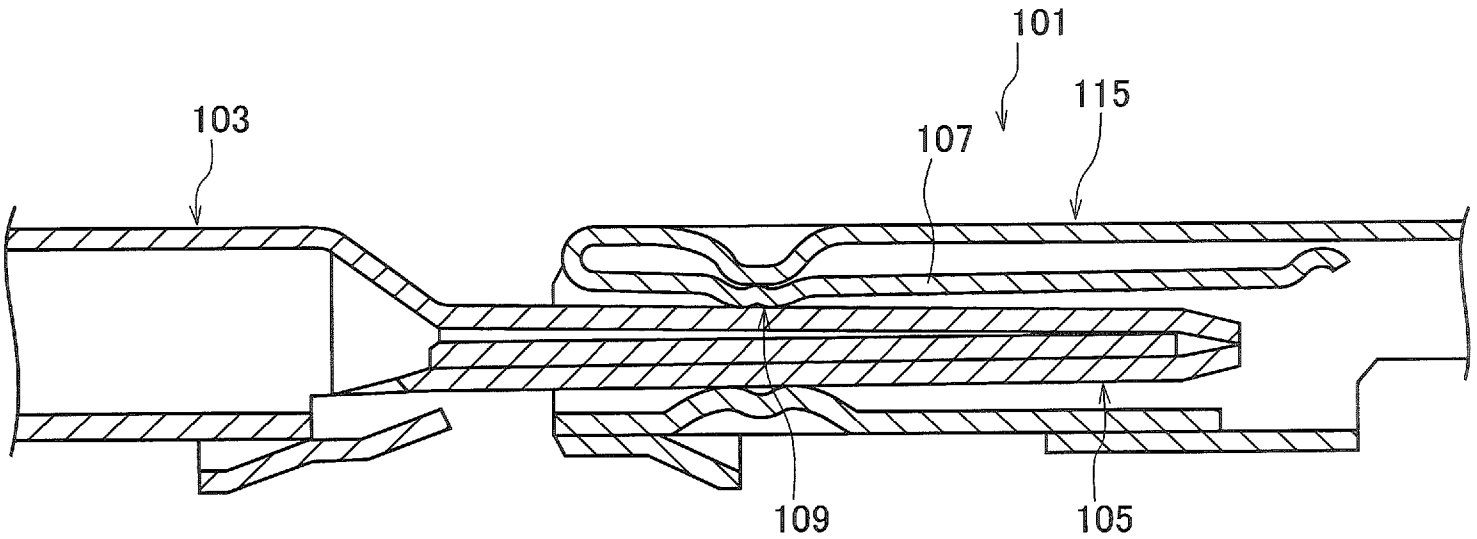
FIG. 8 is a cross-sectional view of a connection terminal according to a second embodiment of the present invention.
Figure 9A:
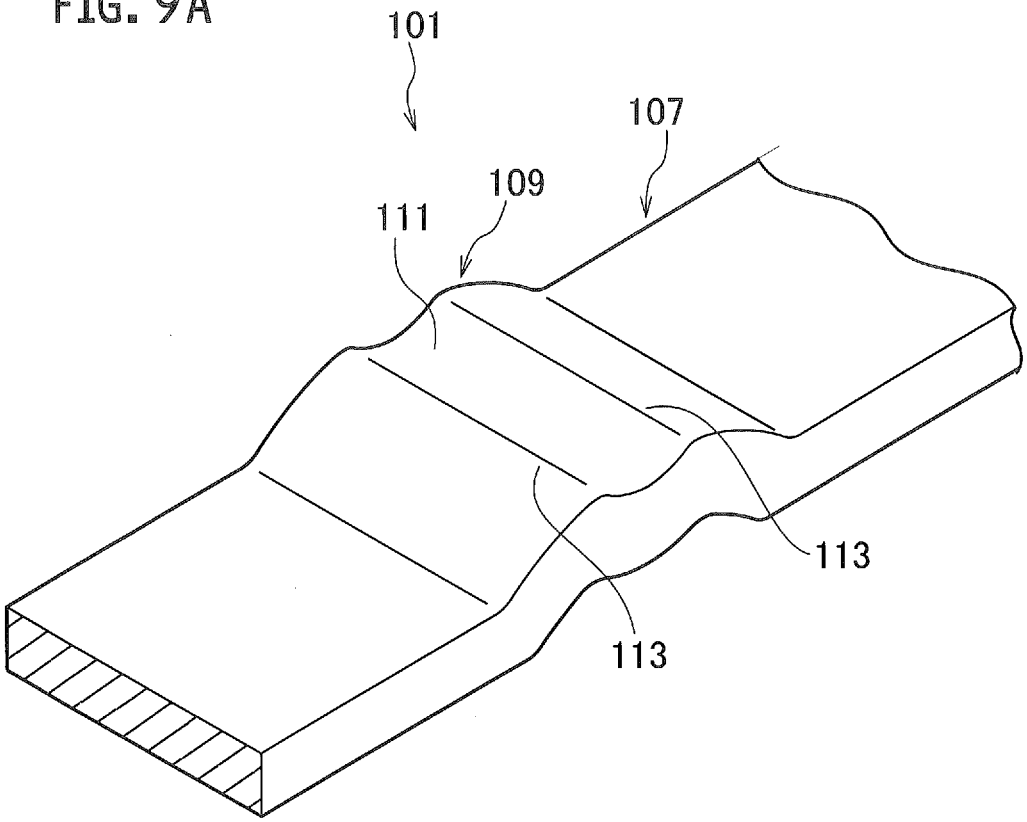
FIG. 9A is a perspective view of an elastic piece of the connection terminal according to the second embodiment of the present invention.
Figure 9B:
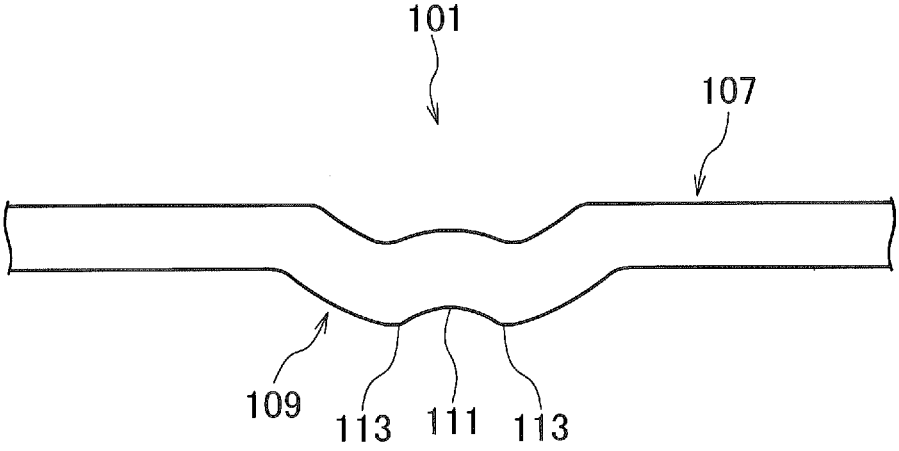
FIG. 9B is a side view of the elastic piece in FIG. 9A.

The results are shown in FIG. 7. The horizontal axis represents a thickness ratio which is a value (t1/a) obtained by dividing the width t1 of the electricity transmitting region by the contact radius a, and the vertical axis represents the conductivity ratio relative to the contact resistance when the entire surface is an electricity transmitting region (inverse number of contact resistance ratio).

As apparent from FIG. 7, about 90% of the total contact resistance is defined in about 20% of the contact region from the outer periphery of the contact portion. Therefore, it can be seen that the current that flows through the contacting section flows dominantly through the outer peripheral portion of the contacting section.

Accordingly, the portion where a current actually flows is only a small part, such as the outer peripheral portion which is apt to transmit electricity well, and thus increasing the contact area of the contacting section 9 excessively is not very effective.

For this reason, in the contacting section 9 of the connection terminal 1, by adopting the outer peripheral portion of the hollow portion 11 as an annular contact portion 13, it is possible to increase the apparent contact surface diameter D, and in addition, to allow a current to flow easily to the annular contact portion 13. Therefore, the contact resistance between the contacting section 9 and the connecting part 5 of the counterpart terminal 3 can be reduced. In addition, without enlarging the contacting section 9 in vain, the increase in the size of the connection terminal 1 can be suppressed.

In the connection terminal 1, the contacting section 9 is formed in a hemispherical shape and has a circular hollow portion 11 formed by recessing the central portion of the contacting section 9 in a direction away from the connecting part 5 of the counterpart terminal 3 and has an annular contact portion 13 formed on the outer periphery of the hollow portion 11. Thus, a current can be allowed to flow easily to the annular contact portion 13 located on the outer periphery of the hollow portion 11 while suppressing an increase in the size of the contacting section 9.

Therefore, without complicating the spring structure for applying urging force to the elastic piece 7 or increasing the size of the connection terminal 1, the contact resistance between the contacting section 9 and the connecting part 5 of the counterpart terminal 3 can be reduced.

Accordingly, by the contacting section 9 with a hollow portion 11 and an annular contact portion 13 having simple structures, the connection terminal 1 can suppress an increase in size, and reduce the contact resistance with simple structures.

Incidentally, in the connection terminal 1 according to the first embodiment, the contacting section 9 is formed in a hemispherical shape and the hollow portion 11 is formed in a circular shape in a plan view of the elastic piece 7, but is not limited thereto. The shape of the contacting section may be of any type, as long as the shape can increase the apparent contact surface diameter D and use the tendency of a current flow, and for example, the contacting section 9 may be formed in a square pole shape, and the hollow portion 11 may be formed in a square shape in a plan view of the elastic piece 7 to adopt the outer peripheral portion as the contact portion 13.

A connection terminal 101 according to a second embodiment of the present invention will be described with reference to FIGS. 8 to 13.

The connection terminal 101 includes an elastic piece 107 which provides urging force toward a connecting part 105 of a counterpart terminal 103, and a contacting section 109 which protrudes from the elastic piece 107 toward the connecting part 105 of the counterpart terminal 103 and which is brought into contact with a surface of the connecting part 105 of the counterpart terminal 103 by the urging force of the elastic piece 107.

The contacting section 109 is formed in a semi-cylindrical shape extending in the width direction of the elastic piece 107 and has a groove-shaped hollow portion 111 formed by recessing the central portion of the contacting section 109 in the length direction of the elastic piece 107 in a direction away from the connecting part 105 of the counterpart terminal 103, and belt-shaped contact portions 113 and 113 which are respectively formed on both sides of the hollow portion 111 in the length direction of the elastic piece 107.

As shown in FIGS. 8 to 10B, the connection terminal 101 is composed of a female terminal having a box-shaped electrical connector 115. The connection terminal 101 is electrically connected to a terminal portion of a wire (not shown) which is connected to a power source or an apparatus, or to a circuit board (not shown) arranged on a power source or an apparatus, or the like.

The connecting part 105 of the counterpart terminal 103 made of a male terminal having the tab-shaped connecting part 105 connected to a power source, an apparatus or the like, similarly to the connection terminal 101 are inserted into the electrical connector 115 of the connection terminal 101, and thereby the connection terminal 101 and the counterpart terminal 103 are electrically connected. The elastic piece 107 is provided within the electrical connector 115 of the connection terminal 101.

The elastic piece 107 is provided by bending the upper wall of the electrical connector 115 toward the inside. With respect to the connecting part 105 of the counterpart terminal 103 inserted into the electrical connector 115, the elastic piece 107 provides (has) predetermined urging force toward the connecting part 105 of the counterpart terminal 103.

The elastic piece 107 is provided with the contacting section 109, and by inserting the connecting part 105 of the counterpart terminal 103 into the electrical connector 115, the contacting section 109 is urged toward the connecting part 105 of the counterpart terminal 103 so as to produce a predetermined contact load, and thereby the contacting section 109 is brought into contact with the connecting part 105 of the counterpart terminal 103.

The contacting section 109 has a central portion in the length direction of the elastic piece 107 protruding toward the connecting part 105 of the counterpart terminal 103 inserted into the electrical connector 115 (toward the lower wall of the electrical connector 115), in a semi-cylindrical shape extending in the width direction of the elastic piece 107, that is, in a semicircular shape in a side view of the elastic piece 107. The contacting section 109 also has a groove-shaped hollow portion 111 and the belt-shaped contact portions 113 and 113.

The hollow portion 111 is formed in a groove shape extending in the width direction of the elastic piece 107 so as to be recessed in a direction away from the connecting part 105 of the counterpart terminal 103 (toward the upper wall of the electrical connector 115) at the central portion of the semi-cylindrical contacting section 109 in the length direction of the elastic piece 107 such that a surface thereof facing the connecting part 105 of the counterpart terminal 103 has a hollow. Both side portions of the hollow portion 111 in the length direction of the elastic piece 107 are formed as the belt-shaped contact portions 113 and 113 respectively. The hollow part of the hollow portion 111 does not come in contact with a surface of the connecting part 105 of the counterpart terminal 103 inserted into the electrical connector 115, that is, having no contact therewith.

The contact portions 113 and 113 are formed on the surface facing the connecting part 105 of the counterpart terminal 103 and are formed in belt shapes as both side portions of the hollow portion 111 in the length direction of the elastic piece 107. The contact portions 113 and 113 are brought into contact with a surface of the connecting part 105 of the counterpart terminal 103 inserted into the electrical connector 115 by the urging force of the elastic piece 107 such that the connection terminal 101 and the counterpart terminal 103 are connected electrically.

Here, the contact resistance can be obtained by the theoretical formula (Formula 1) described in the first embodiment.

Figure 10A:
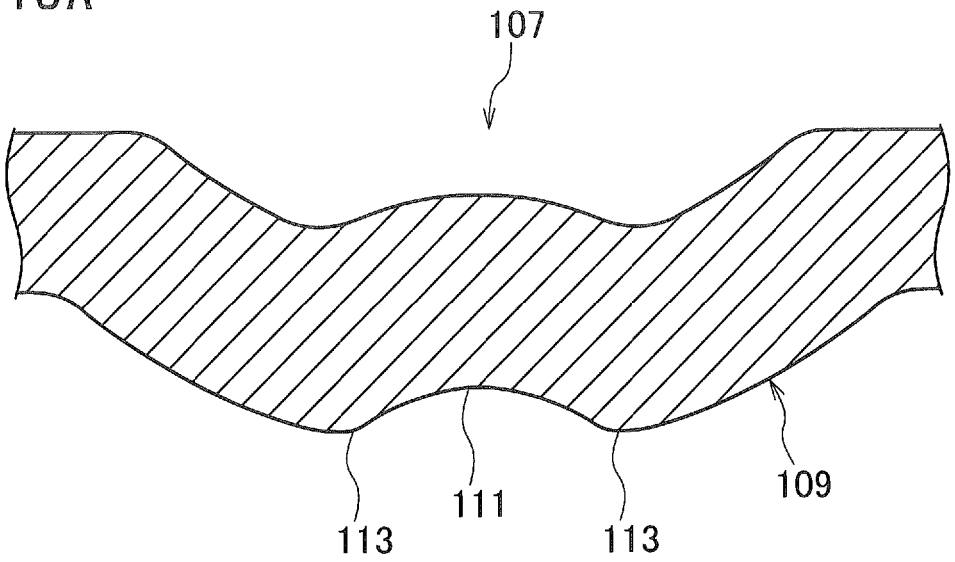
FIG. 10A is a cross-sectional view of a contacting section of the connection terminal according to the second embodiment of the present invention.
Figure 10B:
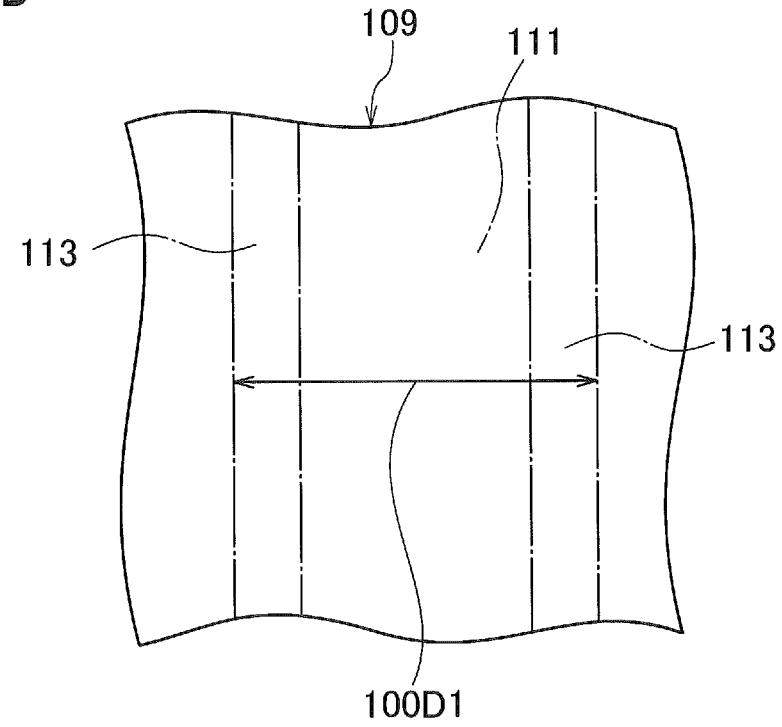
FIG. 10B is a front view of the contacting section in FIG. 10A.
Figure 11A:
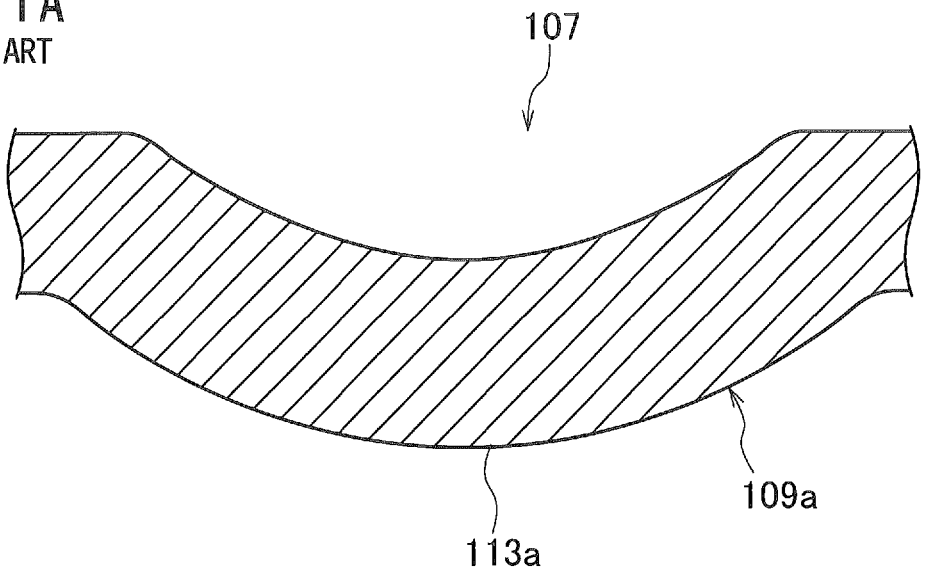
FIG. 11A RELATED ART
FIG. 11A is a cross-sectional view of a contacting section of a related example.
Figure 11B:
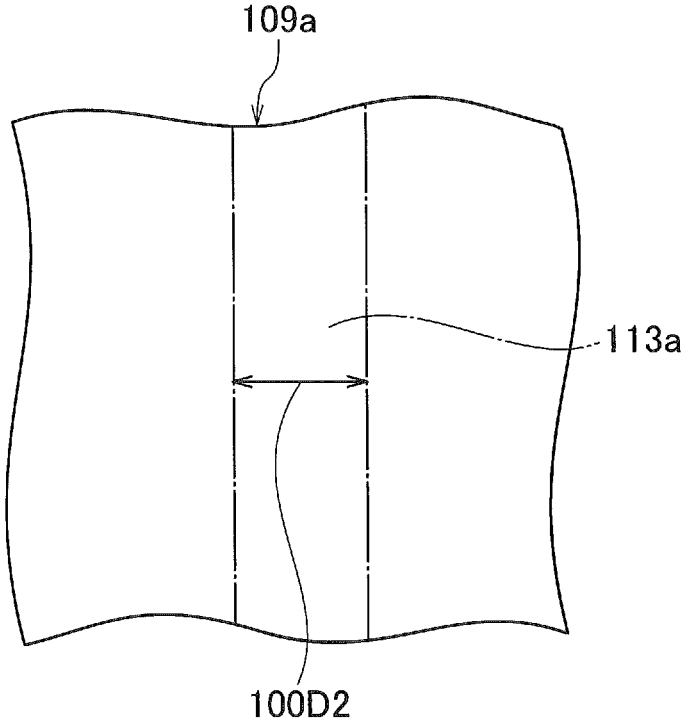
FIG. 11B RELATED ART
FIG. 11B is a front view of the contacting section in FIG. 11A.

Thus, as shown in FIGS. 10A and 10B, the distance between the respective outlines of the contact portions 113 and 113 in the contacting section 109, that is, the apparent contact surface diameter 100D1 is set to be larger than the apparent contact surface diameter 100D2 which is an outer diameter (length) of the contact portion 113*a* of the semi-cylindrical contacting section 109*a*, without the related hollow portion 111 or contact portions 113 and 113, shown in FIGS. 11A and 11B.

Figure 12:
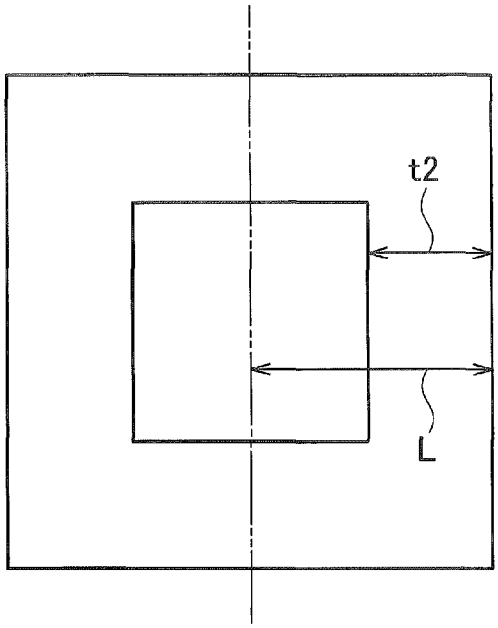
FIG. 12 is a schematic view when the contacting section is formed in a square shape.

On the other hand, in order to verify the flow of current in the contacting section 109, the behavior of the constriction resistance (conductivity ratio) with respect to the apparent contact area in a model shown in FIG. 12 has been verified.

Figure 13:
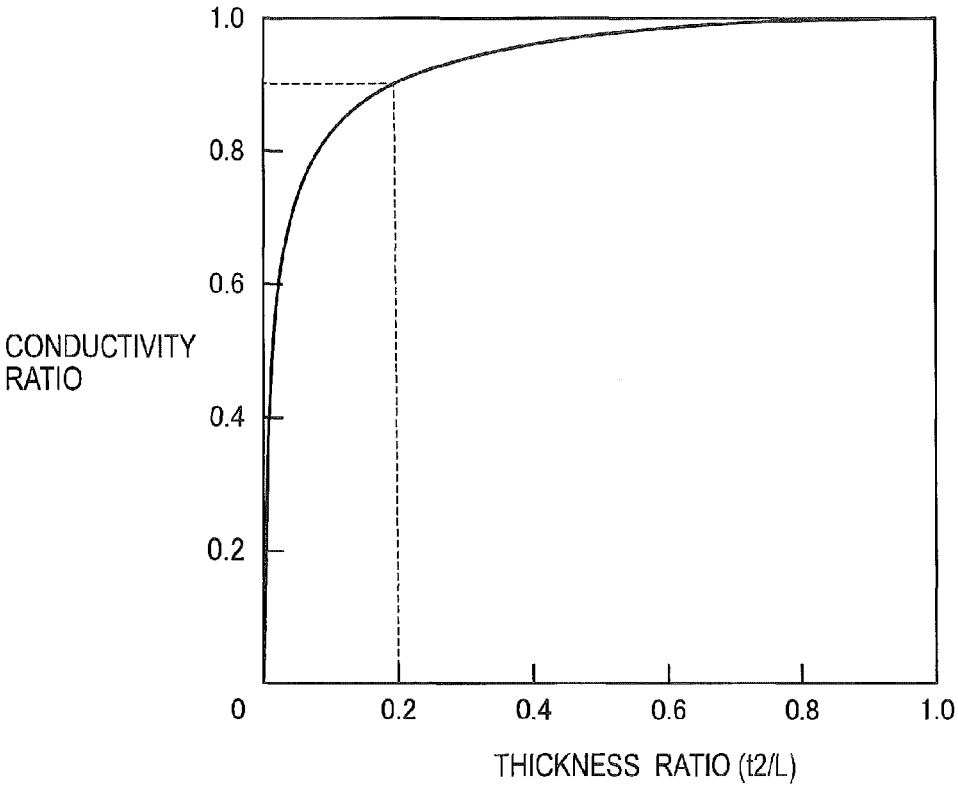
FIG. 13 is a diagram showing variation in a conductivity ratio with respect to a thickness ratio of the contacting section.

The results are shown in FIG. 13. The horizontal axis represents a thickness ratio which is the value (t2/L) obtained by dividing the width t2 of the electricity transmitting region by the length L from the center to the outline of the contacting section, and the vertical axis represents the conductivity ratio relative to the contact resistance when the entire surface is an electricity transmitting region (inverse number of the contact resistance ratio).

As apparent from FIG. 13, about 90% of the total contact resistance is defined in about 20% of the contact region from the outer periphery of the contact portion. Therefore, it can be seen that the current that flows through the contacting section is dominantly flows through the outer peripheral portion of the contacting section.

Accordingly, the portion where a current actually flows is only a small part such as the outer peripheral portion which is apt to transmit electricity well, and thus increasing the contact area of the contacting section 109 excessively is not very effective.

For this reason, in the contacting section 109 of the connection terminal 101, by forming the both side portions of the hollow portion 111 in the length direction of the elastic piece 107, which are outer peripheral portions thereof, as the contact portions 113 and 113, the apparent contact surface diameter D can be increased, and in addition, a current can be allowed to flow easily in the contact portions 113 and 113. Therefore, the contact resistance between the contacting section 109 and the connecting part 105 of the counterpart terminal 103 can be reduced. Furthermore, an increase in the size of the connection terminal 101 can be suppressed without enlarging the contacting section 109 in vain.

In the connection terminal 101, the contacting section 109 is formed in a semi-cylindrical shape extending in the width direction of the elastic piece 107, and has a groove-shaped hollow portion 111 formed by recessing the central portion of the contacting section 109 in the length direction of the elastic piece 107 in a direction away from the connecting part 105 of the counterpart terminal 103 and a belt-shaped contact portions 113 and 113 which are respectively formed on both sides of the hollow portion 111 in the length direction of the elastic piece 107. Thus, a current can be allowed to flow easily to the contact portions 113 and 113 spaced apart so as to sandwich the hollow portion 111 while suppressing an increase in the size of the contacting section 109.

Therefore, the contact resistance between the contacting section 109 and the connecting part 105 of the counterpart terminal 103 can be reduced, without complicating the spring structure for applying urging force to the elastic piece 107 or increasing the size of the connection terminal 101.

Thus, since the contacting section 109 includes the hollow portion 111 and the contact portions 113 and 113 having simple structures, the connection terminal 101 suppresses an increase in size and can reduce the contact resistance with simple structures.

Incidentally, in the connection terminal 101 according to the second embodiment, the contacting section 109 is formed in a semi-cylindrical shape, but is not limited thereto. For example, it is also possible to form the contacting section 109 in a half square pole shape.

Further, the connection terminal 101 according to the second embodiment, the hollow portion 111 is formed in a semicircular shape in aside view of the elastic piece 107, but is not limited thereto. The shape of the hollow portion 111 may be of any type, and for example, may be a recess in a half-square shape in a side view of the elastic pieces 107, as long as the shape has contact portions at both sides of the hollow portion 111 and increases the apparent contact surface diameter D so as to be capable of using the tendency of a current flow.

As described above, in the first and second embodiments, the connection terminals 1 and 101 are provided with the elastic pieces 7 and 107 which provide (have) urging force toward the connecting parts 5 and 105 of the counterpart terminals 3 and 103, and contacting sections 9 and 109 protruding from the elastic pieces 7 and 107 toward the connecting parts 5 and 105 of the counterpart terminals 3 and 103 and being in contact with surfaces of the connecting parts 5 and 105 of counterpart terminals 3 and 103 by the urging force of the elastic pieces 7 and 107. The contacting sections 9 and 109 have the hollow portions 11 and 111 which are located in the centers of the contacting sections 9 and 109, which are recessed in a direction away from the connecting parts 5 and 105 of the counterpart terminals 3 and 103, and which are not in contact with the surfaces of the connecting parts 5 and 105 of the counterpart terminals 3 and 103, and have the contact portions 13 and 113 which are located on each side of the hollow portions 11 and 111 in plan views of the elastic pieces 7 and 107 and which are in contact with the surfaces of the connecting parts 5 and 105 counterpart terminals 3 and 103.

In the first embodiment, the dimension of a hollow portion 11 and the contact portion 13 of the contacting section 9 in a plan view of the elastic piece 7 may be determined such that a value (t1/a) obtained by dividing the width t1 of an electricity transmitting region (the contact portion 13) by a contact radius a (radius of the contacting section 9) is about 0.2. Similarly, in the second embodiment, dimensions of the hollow portion 111 and the contact portion 113 of the contacting section 109 in a plan view of the elastic piece 107 may be determined such that the value (t2/L) obtained by dividing the width t2 of the electricity transmitting region (belt-shaped portion of the contact portion 113) by the length L from the center of the contact point (center of the hollow portion 111 in the longitudinal direction of the elastic piece 107) to the outline (end of the contact portion 113 in the longitudinal direction of the elastic piece 107) is about 0.2. However, the above values (t1/a) and (t2/L) are not limited to 0.2. They can be determined based on the conductivity ratio relative to the contact resistance when the entire surface shown in FIG. 7 described above is an electricity transmitting region (inverse number of the contact resistance ratio) or the shapes of the hollow portions 11 and 111 and the contact portions 13 and 113 or the like. The dimensions of the hollow portions 11 and 111 and the contact portions 13 and 113 of the contacting sections 9 and 109 in plan views of the elastic pieces 7 and 107 may be determined such that the above values (t1/a) and (t2/L) are between 0.05 and 0.6 for example. Of course, the above values (t1/a) and (t2/L) are not limited to values between 0.05 and 0.6, either.

In this way, the present invention includes various embodiments not described above. Therefore, the scope of the present invention is determined only by the invention identification matters according to claims reasonable from the foregoing description.

What is claimed is:

1. A connection terminal comprising:

an elastic piece configured to provide urging force toward a connecting part of a counterpart terminal; and a contacting section protruding from the elastic piece toward the connecting part of the counterpart terminal and configured to come in contact with a surface of the connecting part of the counterpart terminal by the urging force of the elastic piece, wherein the contacting section includes a hollow portion located at a center of the contacting section, having a recess in a direction away from the connecting part of the counterpart terminal, having no contact with the surface of the connecting part of the counterpart terminal, and formed on a surface of the elastic piece facing the connecting part of the counterpart terminal, and a contact portion located to sandwich the hollow portion in a plan view of the elastic piece and configured to come in contact with the surface of the connecting part of the counterpart terminal, the contacting section has a hemispherical shape, the hollow portion has a circular shape in the plan view of the elastic piece, the contact portion has an annular shape located on an outer periphery of the hollow portion in the plan view, an outer diameter of the contact portion is set such that current flow between the contact portion and the connecting part of the counterpart terminal is enhanced without increasing a size of the contacting section, and the outer diameter of the contact portion is increased to increase an apparent contact surface diameter and decrease a contact resistance of the contact portion according to the expression:

$$Rc=(\rho/D)+(\mu/2na);$$

where Rc is the contact resistance, ρ is a volume resistivity of a metal of the contact portion, D is the apparent contact surface diameter, 2a is an actual contact surface diameter and n is a number of actual contact surfaces.

2. The connection terminal according to claim 1, wherein a value obtained by dividing a width of the contact portion in the plan view by a radius of the contacting section in the plan view is in a range of 0.05 to 0.6.

3. The connection terminal according to claim 1, wherein a value obtained by dividing a width of the contact portion in the plan view by a radius of the contacting section in the plan view is 0.2.

4. The connection terminal according to claim 1, wherein the contacting section is formed in a central portion in a width direction of the elastic piece.

5. The connection terminal according to claim 1, wherein a thickness ratio obtained by dividing a width of the contact portion by the outer diameter of the contact portion is set so as to enhance the current flow without increasing the size of the contacting section.

6. The connection terminal according to claim 1, wherein the contact portion is made of a given metal.

7. The connection terminal according to claim 1, wherein the contact portion is made of a given metal, and in the plan view, the outer diameter of the contact portion is increased to be larger than an outer diameter of a comparative circular contact portion made of the given metal of a comparative hemispherical contacting section without a hollow portion and an annular contact portion, a diameter of the comparative hemispherical contacting section being the same as a diameter of the comparative contacting section, the outer diameter of the contact portion increased to decrease a contact resistance of the contact portion relative to a contact resistance of the comparative circular contact portion.

* * * * *